US011560647B1

(12) United States Patent
Trumbull et al.

(10) Patent No.: US 11,560,647 B1
(45) Date of Patent: Jan. 24, 2023

(54) ELASTOMERIC YARN FOR SAFETY APPLICATIONS

(71) Applicants: David Lewis Kitchen Trumbull, Boston, MA (US); James Boland Carson, Jr., Lake Wylie, SC (US)

(72) Inventors: David Lewis Kitchen Trumbull, Boston, MA (US); James Boland Carson, Jr., Lake Wylie, SC (US)

( * ) Notice: Subject to any disclaimer, the term of this patent is extended or adjusted under 35 U.S.C. 154(b) by 0 days.

(21) Appl. No.: 16/403,566

(22) Filed: May 5, 2019

Related U.S. Application Data

(60) Provisional application No. 62/667,796, filed on May 7, 2018.

(51) Int. Cl.

| | |
|---|---|
| ***D02G 3/32*** | (2006.01) |
| ***D02G 3/02*** | (2006.01) |
| ***D02G 3/44*** | (2006.01) |
| ***D01F 6/66*** | (2006.01) |
| ***D01F 6/70*** | (2006.01) |

(52) U.S. Cl.
CPC ..... *D02G 3/32* (2013.01); *D01F 6/66* (2013.01); *D01F 6/70* (2013.01); *D02G 3/02* (2013.01); *D02G 3/44* (2013.01); *D10B 2331/06* (2013.01); *D10B 2331/10* (2013.01); *D10B 2401/061* (2013.01)

(58) Field of Classification Search
CPC ... D02G 3/32; D02G 3/44; D02G 3/02; D10B 2331/06; D10B 2331/10; D10B 2401/061
See application file for complete search history.

(56) References Cited

U.S. PATENT DOCUMENTS

| | | | | |
|---|---|---|---|---|
| 3,630,657 | A * | 12/1971 | Setzer | D06M 13/395 8/115.67 |
| 5,171,633 | A * | 12/1992 | Muramoto | D01F 8/16 428/374 |
| 5,308,697 | A * | 5/1994 | Muramoto | D01F 8/16 428/374 |
| 6,174,602 | B1 * | 1/2001 | Matsui | D01D 5/22 428/373 |
| 6,277,942 | B1 * | 8/2001 | Foss | C08G 18/10 428/364 |
| 2002/0161159 | A1 * | 10/2002 | Vedula | C08G 18/4854 528/44 |
| 2019/0368075 | A1 * | 12/2019 | Suzuki | D01F 6/70 |

FOREIGN PATENT DOCUMENTS

| | | | | |
|---|---|---|---|---|
| WO | WO-2018146192 | A1 * | 8/2018 | D01D 5/10 |

OTHER PUBLICATIONS

Iwona Frydrych, A New Approach for Predicting the Strength Properties of Yarns, Textile Research Journal, vol. 62, Issue 6, Jun. 1, 1992, pp. 340-346, Abstract Only.
Furferi and Gelli, Yarn Strength Prediction: A Practical Model Based on Artificial Neural Networks, Advances in Mechanical Engineering, Article ID 640103, Published 2010.

* cited by examiner

*Primary Examiner* — Rabon A Sergent
(74) *Attorney, Agent, or Firm* — RB Consulting Inc.; James Carson

(57) ABSTRACT

The elastomeric yarn for safety applications discloses an elastomeric yarn that reliably breaks at 200% stretch and is therefore appropriate for use with a sacrificial textile. The elastomeric yarn for safety applications discloses the polyurethane segments, the copolymer segments, the necessary plurality of cross-links required to form a structure of a polyurethane based elastomeric yarn that reliably breaks at 200% stretch.

2 Claims, 6 Drawing Sheets

POLYURETHANE STRUCTURE

ETHYL CARBAMATE

TOLYLENE DIISOCYANATE 1,4- BUTYLENE ADIPATE 1,6 HEXAMC DIISOCYANATE

ELASTOMERIC YARN FOR SAFETY APPLICATIONS

CROSS REFERENCES TO RELATED APPLICATIONS

This non-provisional application claims priority under 35 U.S.C. 119(e) to U.S. provisional application U.S. 2/667,796 filed on May 7, 2018 by the inventor: David Lewis Kitchen Trumbull of Boston, Mass.

STATEMENT REGARDING FEDERALLY SPONSORED RESEARCH

Not Applicable

REFERENCE TO APPENDIX

Not Applicable

BACKGROUND OF THE INVENTION

The present invention relates to the field of textiles including filaments and yarns, more specifically, a conjugated synthetic polymer yarn.

An Overview of Polyurethane Based Elastomeric Yarns:

The most commonly used elastomeric yarn in the textile industry is a polyurethane based elastomeric yarn 100. The polyurethane-based elastomeric yarn 100 is commonly referred to as spandex. As shown in FIG. 1, the polyurethane-based elastomeric yarn 100 is a copolymer based structure that comprises a polyurethane segment 101 and a copolymer segment 102. The polyurethane-based elastomeric yarn 100 is further formed with a plurality of cross-links 103.

As shown in FIG. 2, the polyurethane segment 101 comprises a pair of ethyl carbamate (CAS: 51-76-6) 113 molecules (often informally referred to a urethane molecule) and a urethane link 104. The urethane link 104 is a molecule that links the nitrogen elements of each of the pair of ethyl carbamate (CAS: 51-76-6) 113 molecules to each other. As shown in FIG. 1, the copolymer segment 102 is a molecular structure that interconnects the individual polyurethane segments 101 together to form the polyurethane-based elastomeric yarn 100.

Each of the plurality of cross-links 103 is a bond selected from the group consisting of a molecular bond and a hydrogen bond. Each of the plurality of crosslinks joins a first copolymer based structure selected from the polyurethane-based elastomeric yarn to a second copolymer based structure selected from the polyurethane-based elastomeric yarn. Specifically, the selected molecular bond for each cross-link selected from the plurality of cross-links 103 attaches a first polyurethane segment 101 selected from the first copolymer based structure to a second polyurethane segment 101 selected from the copolymer based structure.

The polyurethane segment 101 and the copolymer segment 102 are typically combined using a condensation polymerization technique. This technique typically results in the polyurethane segment 101 and the copolymer segment 102 being joined by a bond selected from the group consisting of an amide bond, an ester bond, or ether bond. The selection of the bond reflects the specific selection of the molecules used for the polyurethane segment 101 and the copolymer segment 102 as well as the design preferences of the producing organization.

It is commonly said that the polyurethane segment 101 of the polyurethane-based elastomeric yarn 100 is the stiff segment and the copolymer segment 102 of the polyurethane-based elastomeric yarn 100 is the flexible segment of the polyurethane-based elastomeric yarn 100.

The choice of the polyurethane segment 101 and the urethane link 104 is determined by the properties desired in the polyurethane-based elastomeric yarn 100. A representative molecule for the urethane link 104 is 2,4-tolylene diisocyanate (CAS: 584-84-9) 111. A representative molecule for the copolymer segment 102 is 1,4-butylene adipate (CAS: 24936-97-8) 112.

The 2,4-tolylene diisocyanate (CAS: 584-84-9) 111 and the 1,4-butylene adipate (CAS: 24936-97-8) 112 are readily and commercially available, and methods to incorporate these molecules into polymers are well-known and documented.

The single bonds of the 1,4-butylene adipate (CAS: 24936-97-8) 112 make it a relatively flexible molecule that is appropriate for use as the copolymer segment 102. In this scenario, the 1,4-butylene adipate (CAS: 24936-97-8) 112 gives the polyurethane-based elastomeric yarn 100 its stretch. The 2,4-tolylene diisocyanate (CAS: 584-84-9) 111 is typical of the preference for using aromatic molecules for the urethane link 104 of a polyurethane molecule.

The use of aromatic molecules gives the polyurethane segment 101 a volume that the 1,4-butylene adipate (CAS: 24936-97-8) 112 lacks. This volume is important because the aromatic molecules of a polyurethane segment 101 of a first copolymer based structure selected from the polyurethane-based elastomeric yarn will interact with the aromatic molecule contained in the polyurethane segment 101 of a second copolymer based structure selected from the polyurethane-based elastomeric yarn.

This interaction between the aromatic molecules, such as 2,4-tolylene diisocyanate (CAS: 584-84-9) 111 increases the overall stretch of the molecule by protecting the relatively fragile bonds within the copolymer segment 102 from breaking during the stretching process.

The physical process is similar to bringing a bouquet of balloons through a doorway. As the balloons are brought through the doorway, the balloons push against each other in a random fashion such that each balloon prevents the remaining balloons from entering through the doorway. Within the context of a polyurethane-based elastomeric yarn 100, the energy applied to stretch the polyurethane segment 101 is not directly applied to the copolymer segment 102 but is instead diffused through the entire molecular substrate of the polyurethane-based elastomeric yarn 100 by the interactions between the aromatic segments of the polyurethane segment 101. The result is that the polyurethane segment 101 can be stretched over a greater span of length than would be possible if the energy of stretching was applied directly to the copolymer segment 102.

In the above scenario, the interactions between the aromatic elements of the polyurethane segment 101 are physical. While these interactions have some influence on the modulus of a polyurethane-based elastomeric yarn 100, these interactions are primarily used to control the overall level of stretch available from the polyurethane-based elastomeric yarn 100.

The modulus of a polyurethane-based elastomeric yarn 100 is primarily controlled by the plurality of cross-links 103 formed between the polyurethane segments 101 of two different polymer molecules. The greater the number of the plurality of cross-links 103 that are formed between the molecules forming the polyurethane-based elastomeric yarn 100, the greater the modulus of the polyurethane-based elastomeric yarn 100.

An Overview of Sacrificial Textiles:

This disclosure addresses the construction of textiles intended for use as a sacrificial structure.

The typical textile-based sacrificial structure forms a fastening structure used to attach a first object to a second object. The purpose of the textile-based sacrificial structure is to maintain the attachment of the first object to the second object until the tensile force between the first object and the second object reaches a critical point called the break strength of the sacrificial structure. Upon reaching the break strength of the textile-based sacrificial structure, the textile-based sacrificial structure is designed to break thereby separating the first object from the second object. Sacrificial textiles have many applications including, but not limited to, arresting netting and parachute release webbings.

One of the limitations of currently available textile-based sacrificial structures is their non-elastic nature. The inelastic nature of the textile-based sacrificial structure creates a product that does not adjust to accommodate: a) the initial fitting and installation of the textile-based sacrificial structure; nor, b) the differential motion that can occur between the first object and the second object.

While methods to form elastic textiles using elastic yarns is well-known and documented in the textile arts, the current technology of available elastic yarns are not suitable for use in a textile-based sacrificial structure. The reason for this is that the currently available elastic yarns are capable of stretching between five times and eight times the span of the length of the yarn in its relaxed shape. While the break strength of these elastic yarns can be incorporated into the design of break strength of the sacrificial, the elastic nature of the elastic yarn means the first object and the second object remain tethered over a longer span of distance than is desirable. This tethering can further potentially interfere with the operation of other safety devices that may be used in conjunction with the sacrificial textile.

Clearly, an elastic yarn with a breaking property that allows the elastic yarn to reliably break at significantly less than five times the span of the length of the yarn in its relaxed shape would be of benefit to users of sacrificial textiles.

SUMMARY OF INVENTION

The elastomeric yarn for safety applications addresses the above shortcomings of sacrificial textiles. Specifically, the elastomeric yarn for safety applications discloses an elastomeric yarn that reliably breaks at 200% stretch and is therefore appropriate for use with a sacrificial textile.

These together with additional objects, features and advantages of the elastomeric yarn for safety applications will be readily apparent to those of ordinary skill in the art upon reading the following detailed description of the presently preferred, but nonetheless illustrative, embodiments when taken in conjunction with the accompanying drawings.

In this respect, before explaining the current embodiments of the elastomeric yarn for safety applications in detail, it is to be understood that the elastomeric yarn for safety applications is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the elastomeric yarn for safety applications.

It is therefore important that the claims be regarded as including such equivalent construction insofar as they do not depart from the spirit and scope of the elastomeric yarn for safety applications. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
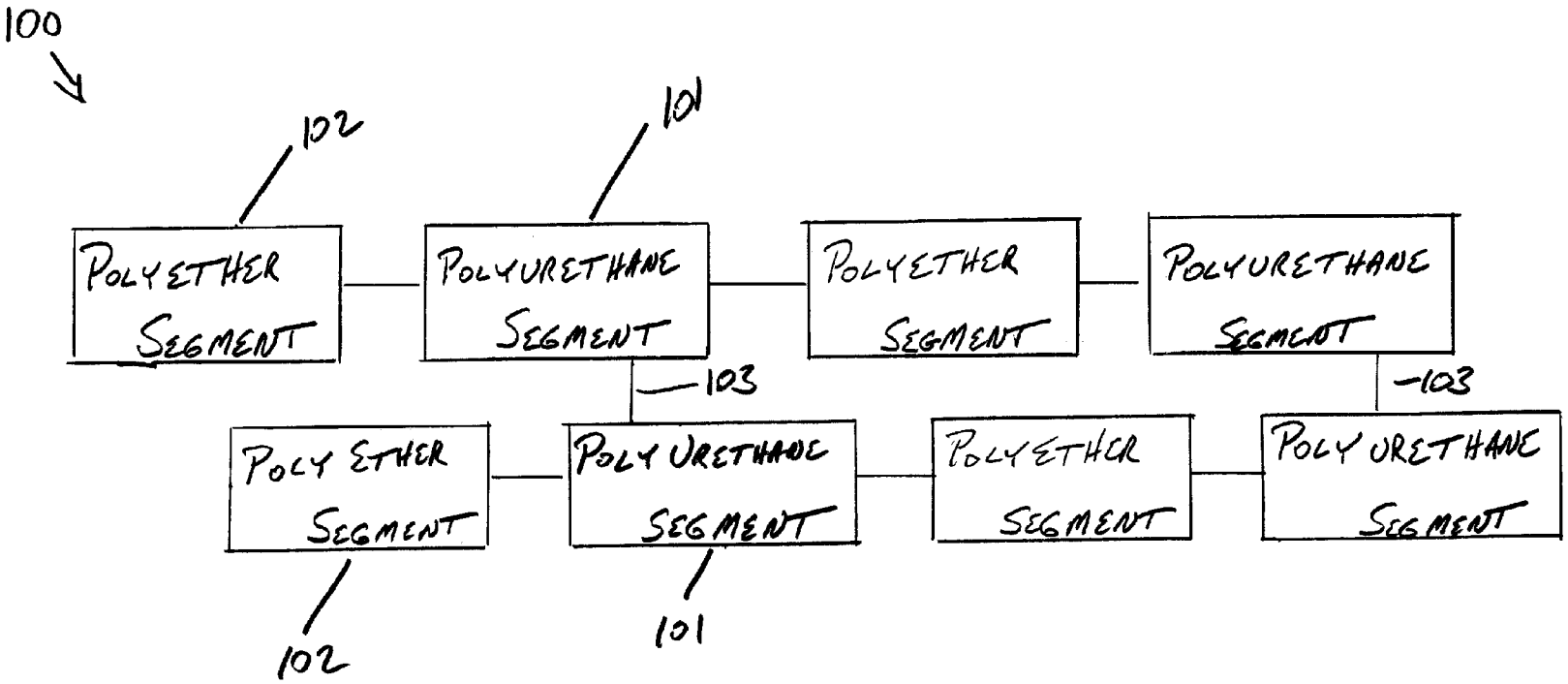
FIG. 1 is a structural view of an embodiment of the disclosure.
Figure 2:
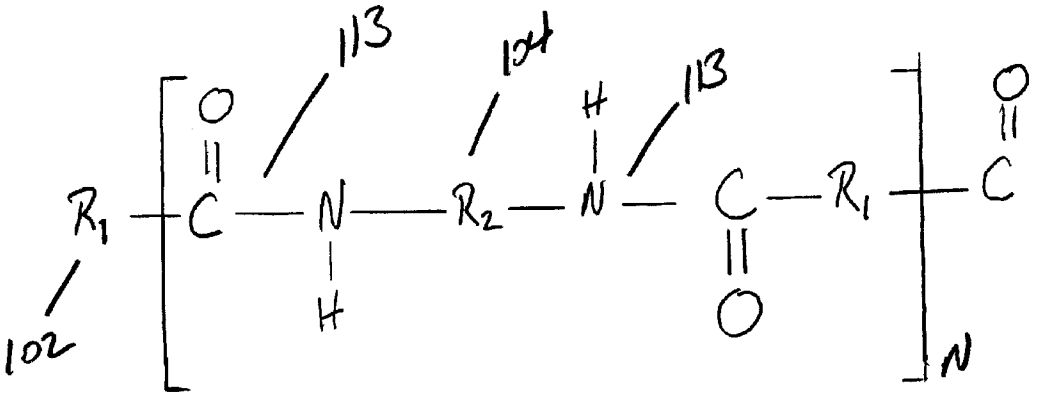
FIG. 2 is a detail view of an embodiment of the disclosure.
Figure 3:
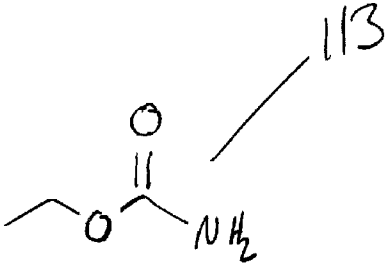
FIG. 3 is a detail view of an embodiment of the disclosure.
Figure 4:
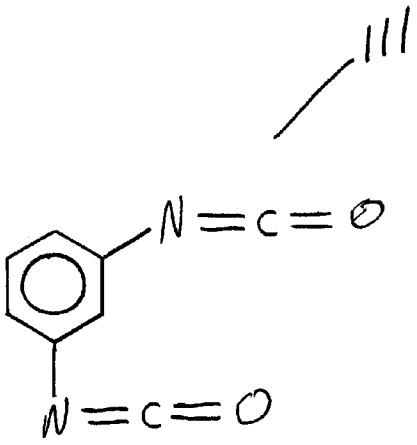
FIG. 4 is a detail view of an embodiment of the disclosure.
Figure 5:
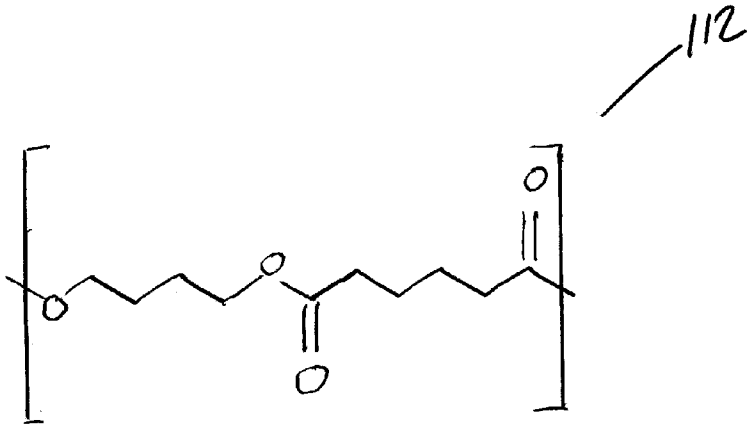
FIG. 5 is a detail view of an embodiment of the disclosure.
Figure 6:
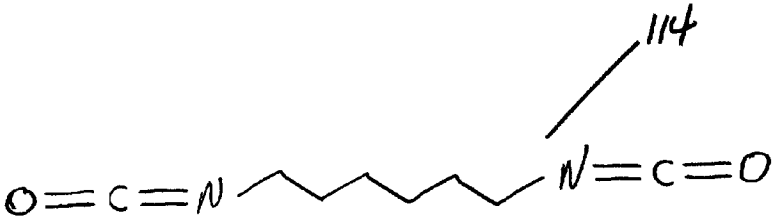
FIG. 6 is a detail view of an embodiment of the disclosure.

Detailed reference will now be made to one or more potential embodiments of the disclosure, which are illustrated in FIGS. 1 through 6.

The disclosed polyurethane based elastomeric yarn 100 takes advantage of the observation that the primary determinant of the overall stretch available from a polyurethane-based elastomeric yarn 100 is separate from the primary determinant of the modulus of the polyurethane-based elastomeric yarn 100. Specifically, this application discloses the substitution of a proportion of aromatic structures that form the urethane link 104 with aliphatic hydrocarbon structures such that P % of the polyurethane segment 101 comprises an aromatic molecule for the urethane link 104 and (1−P) % of the polyurethane segment 101 comprises an aliphatic molecule for the urethane link 104.

For example, the applicant estimates that if the urethane link 104 of the polyurethane segment 101 of a polyurethane-based elastomeric yarn 100 is 2,4-tolylene diisocyanate (CAS: 584-84-9) 111 and the copolymer segment 102 of the polyurethane-based elastomeric yarn 100 is 1,4-butylene adipate (CAS: 24936-97-8) 112, then the replacement of roughly 70% (0.23<=P<=0.37) of the 2,4-tolylene diisocyanate (CAS: 584-84-9) 111 by 1,6-hexanediisocyanate (CAS: 822-06-0) 114 (0.63<=P<=0.77) would result in a polyurethane based elastomeric yarn 100 structure that would break before stretching to three times its relaxed length.

The applicant estimates that substituting the 1,6-hexanediisocyanate (CAS: 822-06-0) 114 in the above ratio would be sufficient to create the described product. This change is not anticipated to require modifications to existing equipment.

More generally, the applicant believes that the substitution of any aromatic ring in a polyurethane segment 101, can be substituted with an aliphatic diisocyanate, including 1,6-hexanediisocyanate (CAS: 822-06-0) 114, to create a similar result.

Once the break stretch is set, the number of the plurality of cross-links 103 between the polymer molecules needs to be established between the remaining aromatic molecules forming the urethane link 104 of the polyurethane segment 101. The process of establishing the plurality of cross-links 103 is similar to the processes used for yarns formed exclusively with the aromatic version of the urethane link 104. The curing time will increase using this method.

Alternately, the curing time can be reduced through the addition of functional groups, such as methyl groups, to the 1,6-hexanediisocyanate (CAS: 822-06-0) 114 thereby increasing the number of bonding sites available for to form the plurality of cross-links 103.

The applicant estimates that to create an elastic yarn that approximates the performance of commercially available spandex yarns at the lower break stretch, an increase in the number of crosslinks per average molecular weight of the polymer of over 30% is required.

The following definitions were used in this disclosure:

Aliphatic: As used in this disclosure, aliphatic refers to an organic molecule that does not contain a ring structure.

Aromatic: As used in this disclosure, aromatic refers to an organic molecule that contains a ring structure.

Carbamate: As used in this disclosure, a carbamate is a functional group consisting of an O—(C═O)—N structure. Carbamate is informally referred to as urethane.

Copolymer: As used in this disclosure, a copolymer is a polymer formed from two or more repeating molecules (also referred to as monomers).

Crosslink: As used in this disclosure, a crosslink refers to a molecular bond or a hydrogen bond that attaches a first molecular chain to a second, parallel, molecular chain. Typically, the molecular chain will be a polymer.

Denier: As used in this disclosure, the term denier is a unit of weight that can be used to describe the fineness of nylon, polyester yarn, rayon, elastomeric or silk yarn. Denier is calculated as grams per 9000 meters.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elastic Textile: As used in this disclosure, an elastic textile is a textile that contains elastic yarns as some of the yarns that make up the textile. An elastic textile is constructed such that the elastic textile will stretch when a force is applied and will return to its original shape when after the force is removed.

Elastic Webbing: As used in this disclosure, an elastic webbing is a webbing that contains elastic yarns as some of the yarns that make up the webbing. An elastic webbing is constructed such that the elastic webbing will stretch when a force is applied and will return to its original shape when after the force is removed.

Elastic Yarn: As used in this disclosure, an elastic yarn is a yarn formed from elastomeric materials.

Fastener: As used in this disclosure, a fastener is a device that is used to join or affix a first object to a second object.

Hydrogen Bond: As used in this disclosure, a hydrogen bond refers to an electrostatic attraction between: 1) a cation and an anion; 2) a cation and a negative dipole; or, 3) an anion and a positive dipole. The exchange of electrons (as would occur in an ionic bond or covalent bond) does not occur in a hydrogen bond. As a rule, the energy to break an ionic bond is less than the energy required to break a covalent bond or an ionic bond.

Modulus: As used in this disclosure, the modulus of an elastomeric material is a function that describes the percentage change in the span of the elastomeric material as a function of the force applied to elastomeric material. When comparing modulus, a larger modulus is taken to imply that an increase in force is required to get the same percentage change in the elastomeric material.

Monofilament: As used in this disclosure, a monofilament refers to a yarn or a cord that is formed from a single continuous filament.

Monomer: As used in this disclosure, a monomer refers to a molecular structure that bonds to itself in a repeating manner to form a polymer.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

Organic: As used in this disclosure, organic refers to a carbon-based chemical structure. A limited number of carbon-based salts are traditionally considered inorganic chemical structure and are excluded from the study of organic chemistry.

Polymer: As used in this disclosure, a polymer refers to a molecular chain that comprises multiple repeating units known as monomers. The repeating unit may be an atom or a molecular structure.

Polyurethane: As used in this disclosure, a polyurethane is a copolymer wherein the one or more monomer chains are linked together carbamates.

Relaxed Shape: As used in this disclosure, a structure is considered to be in its relaxed state when no shear, strain, or torsional forces are being applied to the structure.

Roughly: As used in this disclosure, roughly refers to a comparison between two objects. Roughly means that the difference between one or more parameters of the two compared are not significantly different.

Sacrificial Structure: As used in this disclosure, a sacrificial structure is a first object or structure that protects a second object or structure from damage. More specifically, the sacrificial structure protects the second object or structure by being damaged instead of the second object or structure.

Tether: As used in this disclosure, a tether is a cord, line, webbing, or strap that is attached to an object to restrict its movement.

Textile: As used in this disclosure, a textile is a material that is woven, knitted, braided or felted. Synonyms in common usage for this definition include fabric and cloth.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips. Webbings have tensile strength but are too flexible to provide compressive strength and are not suitable for use in pushing objects.

Yarn: As used in this disclosure, a yarn is a continuous strand of textile fibers and filaments. Yarns are generally used in the production of fabrics. For the purposes of this disclosure, this definition explicitly includes yarns formed from a single filament such as a monofilament yarn.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A polyurethane-based elastomeric yarn comprising a copolymer based structure;

wherein the copolymer based structure comprises a plurality of individual copolymer structures and a plurality of cross-links;

wherein each individual copolymer structure comprises a plurality of polyurethane segments and a plurality of copolymer segments;

wherein each polyurethane segment selected from the plurality of polyurethane segments is selected from the group consisting of an aromatic molecule and an aliphatic molecule;

wherein the proportion of the plurality of polyurethane segments that comprises an aromatic molecular section is a number P;

wherein P is greater than or equal to zero;

wherein P is lesser than or equal to one;

wherein the proportion of the plurality of polyurethane segments that comprises an aliphatic molecular section is equal to (1−P);

wherein the copolymer segment is a molecular structure that interconnects the individual polyurethane segments;

wherein each cross-link selected from the plurality of crosslinks joins a first individual copolymer structure selected from the plurality of individual copolymer structures of the polyurethane-based elastomeric yarn to a second individual copolymer structure selected from the plurality of individual copolymer structures of the polyurethane-based elastomeric yarn;

wherein the polyurethane-based elastomeric yarn breaks at a span of stretched length lesser than three times the relaxed length of the polyurethane-based elastomeric yarn;

wherein each cross-link selected from the plurality of cross-links attaches a first polyurethane segment selected from the plurality of polyurethane segments of the first individual copolymer structure to a second polyurethane segment selected from the plurality of polyurethane segments of the second individual copolymer structure;

wherein the aromatic molecule selected for the polyurethane segment is an aromatic diisocyanate;

wherein the aliphatic molecule selected for the polyurethane segment is an aliphatic diisocyanate;

wherein the aromatic molecule selected for the polyurethane segment is 2,4-tolylene diisocyanate (CAS: 584-84-9);

wherein the aliphatic molecule selected for the polyurethane segment is 1,6-hexanediisocyanate (CAS: 822-06-0);

wherein the value of P is greater than 0.23;

wherein the value of P is lesser than 0.37.

2. The polyurethane-based elastomeric yarn according to claim 1 wherein the copolymer segment is derived from 1,4-butylene adipate (CAS: 24936-97-8).

* * * * *